US005967894A

United States Patent [19]

Kinoshita et al.

[11] Patent Number: 5,967,894

[45] Date of Patent: Oct. 19, 1999

[54] GAMING APPARATUS AND METHOD THAT INDICATES ODDS FOR WINNING CARD HANDS

[75] Inventors: Yoshihiro Kinoshita, Isehara; Isao Matsuoka, Ebina; Yoichi Okuda, Yokohama, all of Japan

[73] Assignee: Konami Co., Ltd., Hyogo-ken, Japan

[21] Appl. No.: 08/801,660

[22] Filed: Feb. 18, 1997

[30] Foreign Application Priority Data

Feb. 19, 1996 [JP] Japan ..... 8-053658

[51] Int. Cl.[6] ..... A63F 9/22

[52] U.S. Cl. ..... 463/13; 463/12

[58] Field of Search ..... 463/13, 12, 16

[56] References Cited

U.S. PATENT DOCUMENTS

| | | | |
|---|---|---|---|
| 5,046,735 | 9/1991 | Hamano et al. . | |
| 5,294,120 | 3/1994 | Schultz | 463/13 |
| 5,356,140 | 10/1994 | Dabrowski et al. | 463/13 X |
| 5,377,993 | 1/1995 | Josephs | 463/13 X |
| 5,401,023 | 3/1995 | Wood | 463/13 |
| 5,415,404 | 5/1995 | Joshi et al. | 463/13 |
| 5,511,781 | 4/1996 | Wood et al. | 463/13 |

FOREIGN PATENT DOCUMENTS

| | | |
|---|---|---|
| 739650 | 2/1995 | Japan . |
| WO 94 01840 | 2/1994 | WIPO . |

*Primary Examiner*—Michael O'Neill
*Attorney, Agent, or Firm*—Jordan and Hamburg LLP

[57] ABSTRACT

An image display game apparatus has a display screen which displays randomly selected five cards with their faces up. Based on the player's evaluation of the cards, the player selectively presses a first group of push buttons to select unwanted cards and indicate replacement of the cards. When the player presses a push button in a second group, the selected unwanted cards are replaced with new cards. If the new combination of the cards achieves a prize-winning hand, then the player wins and is awarded a credit based on odds for the prize-winning hand. The player then pushes another push button in the second group to receive medals corresponding to the credit. The image display game apparatus has an odds display device which displays a present prize-winning hand and odds thereof, a possible prize-winning hand and odds thereof, and other prize-winning hands and odds thereof in respective display modes, e.g., color shades, different from each other.

20 Claims, 8 Drawing Sheets

GAMING APPARATUS AND METHOD THAT INDICATES ODDS FOR WINNING CARD HANDS

BACKGROUND OF THE INVENTION

1. Field of the Invention

The present invention relates to an image display game apparatus which can be operated by the player to play an image display game, e.g., a card game such as a poker game, by displaying the rank markings of cards on a display screen, replacing a selected one or ones of the displayed cards based on player's evaluation of the displayed rank markings, and determining whether the resulting combination of displayed cards makes up a prize-winning hand or not, and more particularly to such an image display game apparatus having an odds display device for displaying presently achieved, possible, and impossible prize-winning hands and their odds in different display modes for easy visual recognition.

2. Description of the Prior Art

One conventional image display card game apparatus for playing a card game, typically a poker game, is disclosed in Japanese laid-open patent publication No. 7-39650, for example.

When the card game starts being played by the player on the conventional image display card game apparatus, the apparatus displays on a display screen a plurality of, e.g., five, randomly chosen cards, with their faces up. Depending on the evaluation of the cards, the player selects desired cards from the displayed cards and replaces unwanted cards with new cards in an attempt to achieve a prize-winning hand. If a prize-winning hand is achieved by the replacement of the cards, then a payoff is determined according to odds predetermined for the prize-winning hand. Available prize-winning hands and odds are displayed as an odds table on the display screen. The player carries out the card game while confirming the odds for the prize-winning hands.

In the conventional image display card game apparatus, the information of the odds table is displayed uniformly, and do not assist the player in avoiding replacement of a card or cards due to a wrong decision, possibly resulting in a failure to achieve a desired prize-winning hand. Furthermore, with the uniformly displayed information of the odds table, it will take a long period of time for a player who is not familiar with the card game to become accustomed to the card game. Therefore, the player may possibly lose interest in the card game played on the conventional image display card game apparatus.

SUMMARY OF THE INVENTION

It is an object of the present invention to provide an image display game apparatus which assists the player in making correct decisions awhile playing a game on the image display game apparatus and allows the player to become accustomed to the game within a relatively short period of time, so that the player will find it interesting and enjoyable to play the game on the image display game apparatus.

The above object can be accomplished in accordance with the present invention an image display game apparatus comprising an image display unit having a display screen, display control means for controlling the image display unit to display a plurality of rank markings on the display screen, replacement indicating means operable by a player for indicating replacement of at least one of the rank markings, rank marking replacing means for replacing the at least one of the rank markings in response to a replacement indicating signal from the replacement indicating means, end indicating means operable by the player for indicating an end of a game session, prize-winning hand determining means for determining whether the rank markings displayed on the display screen achieve a prize-winning hand in response to an end indicating signal from the end indicating means, and odds display means for displaying a present prize-winning hand which is achieved by rank markings presently displayed on the display screen and odds thereof and other prize-winning hands and odds thereof in respective display modes different from each other.

According to the present invention, there is also provided an image display game apparatus comprising an image display unit having a display screen, display control means for controlling the image display unit to display a plurality of rank markings on the display screen, replacement indicating means operable by a player for indicating replacement of at least one of the rank markings, rank marking replacing means for replacing the at least one of the rank markings in response to a replacement indicating signal from the replacement indicating means, end indicating means operable by the player for indicating an end of a game session, prize-winning hand determining means for determining whether the rank markings displayed on the display screen achieve a prize-winning hand in response to an end indicating signal from the end indicating means, and odds display means for displaying a possible prize-winning hand which may be achieved if at least one of rank markings presently displayed on the display screen is replaced by the rank marking replacing means and odds thereof and other prize-winning hands and odds thereof in respective display modes different from each other.

The image display unit serves to display rank markings, such as those on cards, and may comprise an electric or electronic image display device such as a CRT, a liquid crustal display panel, or the like, or a mechanical image display device for periodically changing and presenting plain pictures on its front side. If a CRT, a liquid crystal display panel, or the like is employed, then its display screen is not required to be positioned on the front side of the image display game apparatus. However, the display screen may be positioned within the image display game apparatus and displayed images may be transmitted to front side of the image display game apparatus via optical path changing means such as mirrors. In this case, the displayed images may be combined with a still or moving image produced by a georama or the like and transmitted through half-silvered mirrors. If the image display unit comprises a CRT, a liquid crystal display panel, or the like, then the display control means may have a device for outputting a video signal to indicate a color for each of the pixels of the CRT, the liquid crystal display panel, or the like. If the image display unit comprises a mechanical image display device for periodically changing and presenting plain pictures on its front side, then the display control means may have a device for outputting a picture changing control signal.

Each of the replacement indicating means and the prize-winning hand determining means comprises a plurality of push buttons and switches combined respectively therewith. Alternatively, each of the replacement indicating means and the prize-winning hand determining means may comprise a joy stick, a track ball, or the like.

The odds display means which displays prize-winning hands and their odds may comprise a device for controlling the display control means for controlling the image display unit. If the image display unit comprises a CRT, a liquid crystal display panel, or the like, then the odds display means may be arranged to display the prize-winning hands and their odds in different colors, different color shades, or different flicker rates. It is also possible not to display one of the prize-winning hands and their odds. However, at least all the prize-winning hands should preferably be visually distinguishably recognizable to provide guidance for unskilled players.

Preferably, the odds display means should display the present prize-winning hand and odds thereof and the other prize-winning hands and odds thereof in respective color shades different from each other, or should display the possible prize-winning hand and odds thereof and the other prize-winning hands and odds thereof in respective color shades different from each other.

As a consequence, the present and/or possible prize-winning hand and odds thereof and the other prize-winning hands and odds thereof are displayed in a manner to enable the player to visually distinguish those different prize-winning hand and odds thereof.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
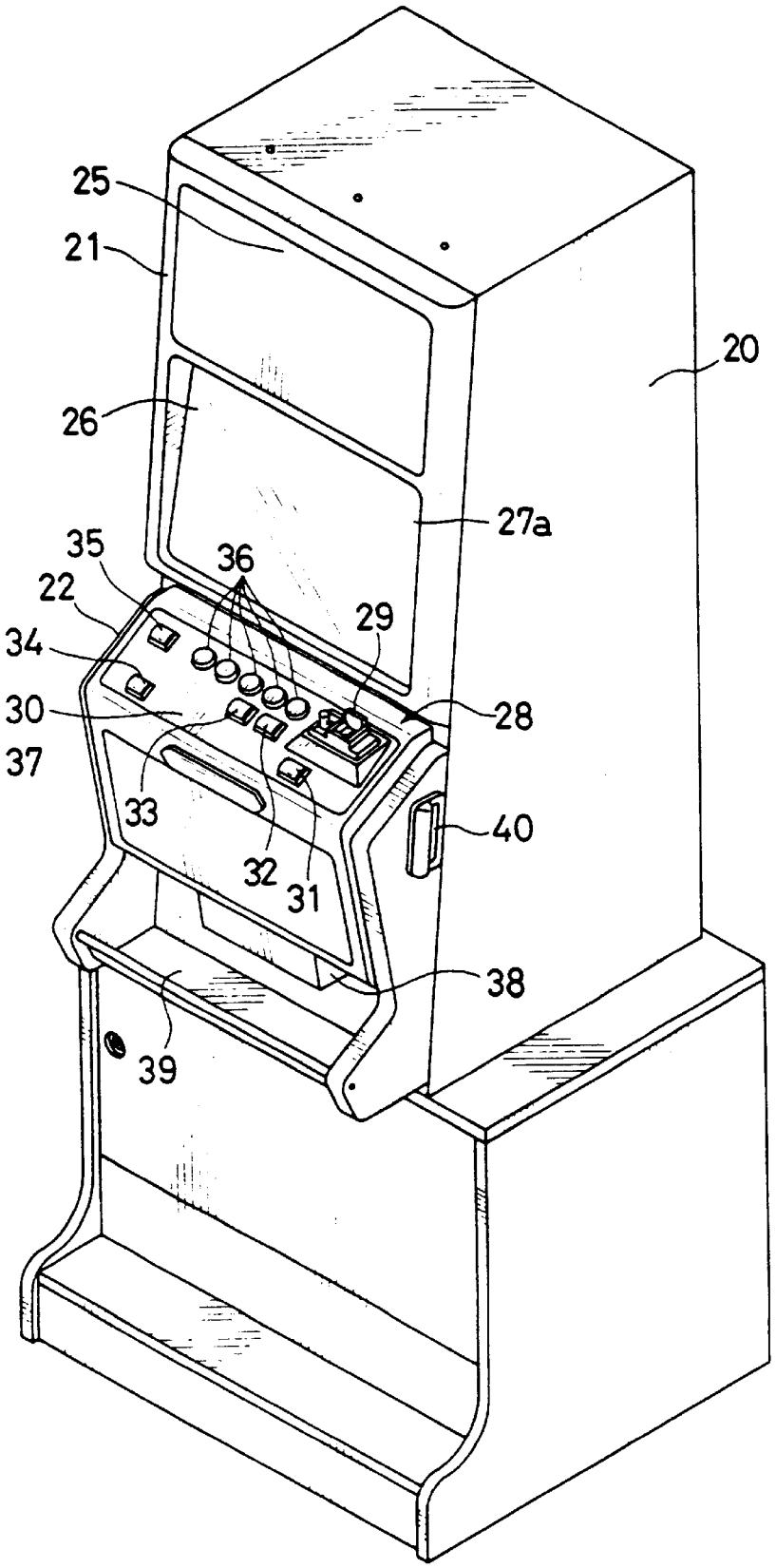
FIG. 1 is a perspective view of an image display game apparatus according to the present invention.
Figure 2:
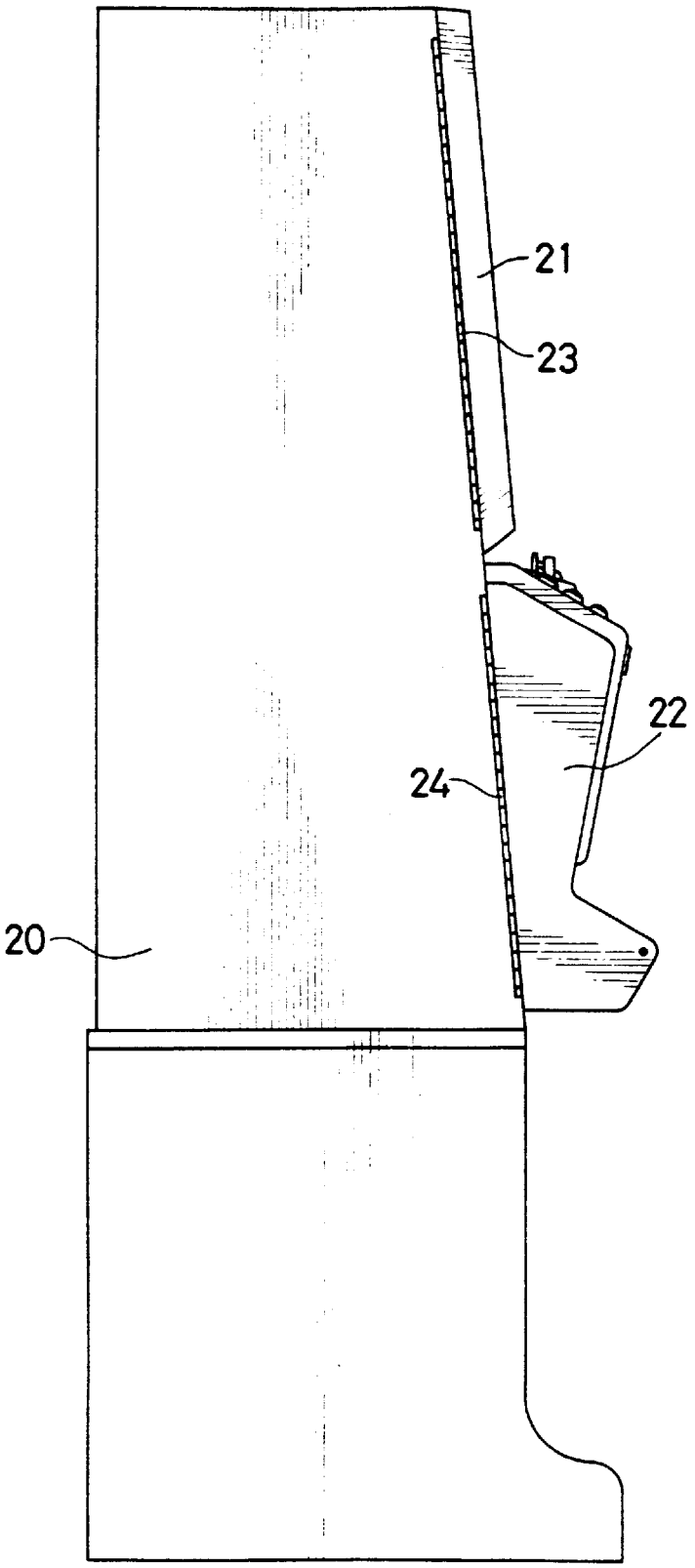
FIG. 2 is a left-hand side elevational view of the image display game apparatus shown in FIG. 1.
Figure 3:
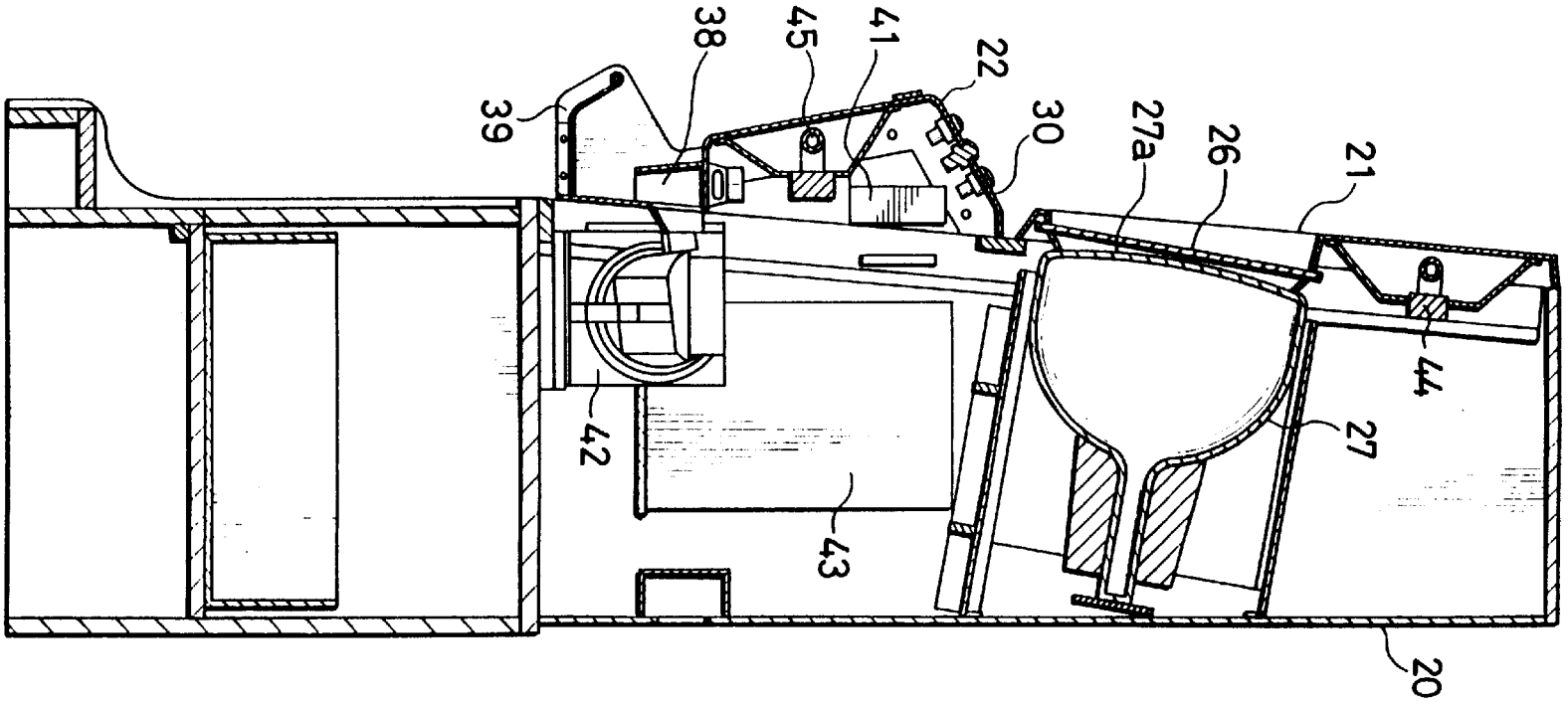
FIG. 3 is a vertical cross-sectional view of the image display game apparatus shown in FIG. 1.

FIGS. 1 through 3 show structural details of an image display game apparatus according to the present invention. The image display game apparatus according to the present invention is typically embodied as an image display card game apparatus for playing an image display game, typically a card game such as a poker game.

When a poker game starts to be played by the player on the image display card game apparatus according to the present invention, the image display card game apparatus displays a plurality of, e.g., five, randomly selected cards, with faces up, on a display screen. The player inspects the displayed cards, and depending on the evaluation of the cards, the player selects a desired card or cards to be held from the displayed cards, and replaces any remaining card or cards with a new card or cards, acquiring a new combination of displayed cards in an attempt to achieve a prize-winning hand. If the new combination represents a prize-winning hand, then the image display card game apparatus gives the player a corresponding payoff in the form of medals.

As shown in FIGS. 1 through 3, the image display card game apparatus has a box-shaped main housing 20 which houses various devices therein as described later on. First and second doors 21, 22, which are separate from each other, are mounted on a front side of the main housing 20. The first and second doors 21, 22 are pivotally supported on the main housing 20 by respective hinges 23, 24 (see FIG. 2) such that they are horizontally openable and closable independently of each other. The first and second doors 21, 22 are usually locked to the main housing 20 by a lock mechanism (not shown), and can be opened and closed when they are unlocked from the lock mechanism by a key (not shown).

The front door 21 is disposed on an upper portion of the front side of the main housing 20. The front door 21 supports on its upper portion a title panel 25 carrying the name and other information of the image display card game apparatus. The front door 21 also supports on its lower portion a display window 25 through which the player of the image display card game apparatus can view a display screen 27*a* of a CRT 27 (see FIG. 3) that is housed in the main housing 20. When a poker game is played on the image display card game apparatus, a display controller (see FIG. 5) in the image display card game apparatus controls the CRT 27 to display on the display screen 27*a* a horizontal array of five cards, with their faces up or down, and also the odds, the number of inserted medals, and the number of bets for each of prize-winning hands, as described later on.

The second door 22 is disposed on a lower portion of the front side of the main housing 20. The second door 22 has an upper portion projecting forward (to the right in FIG. 2) and having an upper surface serving as a console 28. The console 28 has a medal insertion slot 29 defined in a right end thereof and a control panel 30 disposed centrally thereon. The medal insertion slot 29 receives medals one by one which are successively inserted by the player for use in the poker game played on the image display card game apparatus. Since details of the medal insertion slot 29 and a medal receiving mechanism associated therewith are well known in the art, they will not be described below.

Figure 4:
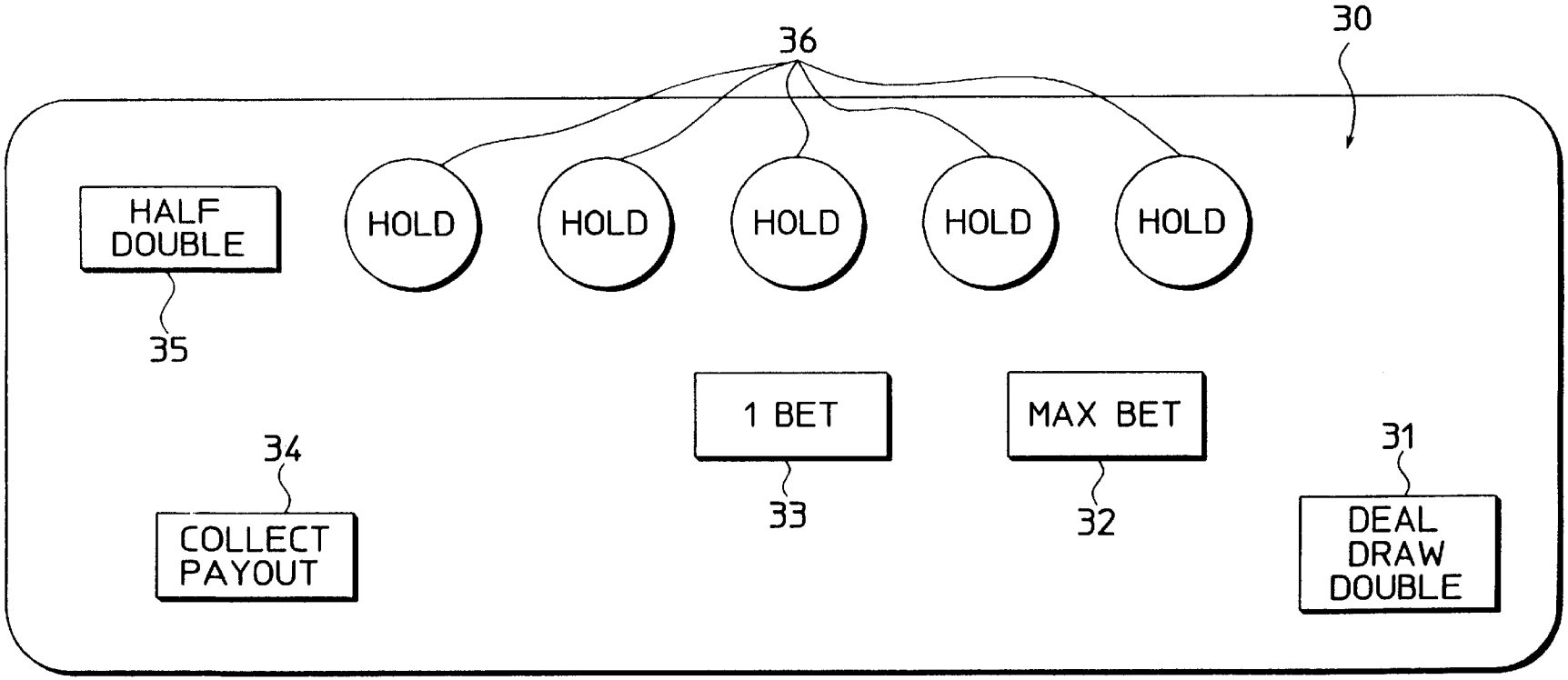
FIG. 4 is an enlarged plan view of a control panel of the image display game apparatus shown in FIG. 1.

FIG. 4 shows the control panel 30 at an enlarged scale. As shown in FIG. 4, the control panel 30 has a total of ten push buttons. The push buttons include a DEAL/DRAW button 31, a MAX BET button 32, a ONE BET button 33, a COLLECT/PAYOUT button 31, and a HALF/DOUBLE button 35 arranged successively in the order named from the right end as viewed from the player. The other push buttons which are positioned remoter from the player are five HOLD buttons 36 arranged in a horizontal array. The HOLD buttons 36 are positioned such that they are located below and in front of the respective five cards displayed on the display screen 27*a*. The push buttons 31~36 house respective lamps 55 (see FIG. 7) therein which can be energized when the player presses the push buttons 31~36.

As shown in FIG. 1, the second door 22 supports on its center a title panel 37 carrying the name and other information of the image display card game apparatus. A medal discharge outlet 38 is mounted on a lower portion of the second door 22 for discharging medals. Medals which are discharged from the medal discharge outlet 38 are received and stored in a medal reservoir 39 mounted on the lower end of the second door 22. A grip 40 is mounted on the right-hand side of the second door 22.

As shown in detail in FIG. 3, a medal selector 41 is mounted on the back of the second door 22 for detecting whether a medal is inserted or not and sorting out medal types and true and false medals. A medal hopper 42 is housed in the main housing 20 behind the second door 22 for temporarily storing medals sorted out by the medal selector 41, and counting and discharging a predetermined number of medals through the medal discharge outlet 38 in response to a command from control system 43 which is also housed in the main housing 20 behind the second door 22. The control system 43 serves to control the image display card game apparatus in its entirety. A lighting device 44 is mounted on the back of the first door 21 for illuminating the title panel 25 from its rear surface. A similar lighting device 45 is mounted on the back of the second door 22 for illuminating the title panel 37 from its rear surface.

Figure 5:
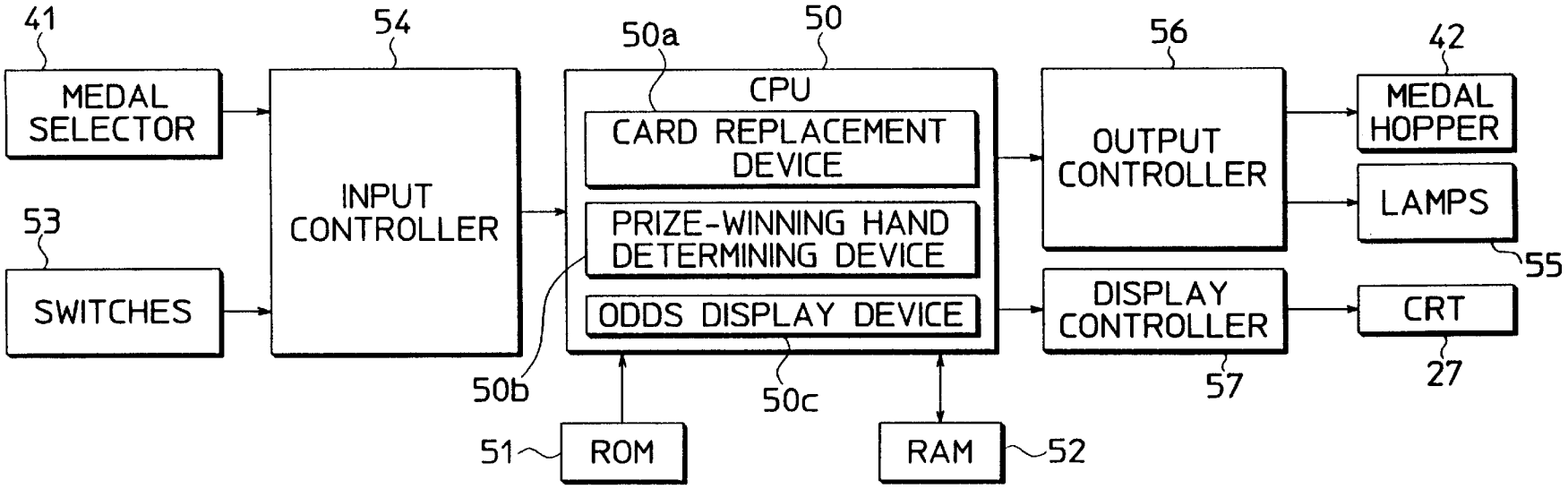
FIG. 5 is a block diagram of a system arrangement of the image display game apparatus shown in FIG. 1.

FIG. 5 shows in block form a system arrangement of the image display card game apparatus. A central processing unit (CPU) 50 controls various operations of the image display card game apparatus and the progress of the poker game played on the image display card game apparatus according to a poker game program stored in a read-only memory (ROM) 51.

The CPU 50 has a card replacement device 50*a*, a prize-winning hand determining device 50*b*, and an odds display device 50*c*, all as functions performed by the CPU 50 according to the poker game program stored in the ROM 51. The card replacement device 50*a* replaces cards (represented by 63 in FIG. 6) with associated HOLD buttons 36 not pressed With new cards when a DEAL/DRAW, button 31 is pressed. The prize-winning hand determining device 50*b* determines whether the new combination of cards obtained after the replacement of cards makes up a predetermined prize-winning hand or not. The odds display device 50*c* outputs a control signal for displaying odds corresponding to a prize-winning hand on the display screen 27*a*, to a display controller When replacement of cards is indicated by not pressing corresponding HOLD buttons 36, the odds display device 50*c* determines and displays the odds of a present prize-winning hand made up of those cards which are not replaced, and the odds of a prize-winning hand which may possibly be achieved by the replacement of cards, in a manner to be visually distinguished from the odds of other prize-winning hands, as described in detail below.

The ROM 51 stores, in addition of the poker game program, character data for producing cards and characters, and a program for controlling images displayed on the display screen 27*a*. A random-access memory (RAM) 52 serves to temporarily store various data supplied from the CPU 50.

Switches 53, shown collectively in FIG. 5, are combined respectively with the push buttons 31~36, and output respective signals upon detecting when the push buttons 31~36 are pressed. Signals outputted from these switches 53 and a signal supplied from the medal selector 41 as indicating an inserted medal detected by the medal selector 41 are supplied through an input controller 54 to the CPU 50. The CPU 50 outputs signals for controlling the lamps 55 combined with the rush buttons 31~36 and the medal hopper 42. These outputted signals are supplied through an output controller 56 to the lamps 55 and the medal hopper 42. The CPU 50 also outputs a display control signal required for the progress of the poker game to the display controller 57,. In response to the display control signal, the display controller 57 sends an image signal to the CRT 27 to display an image on the display screen 27*a*.

Figure 6:
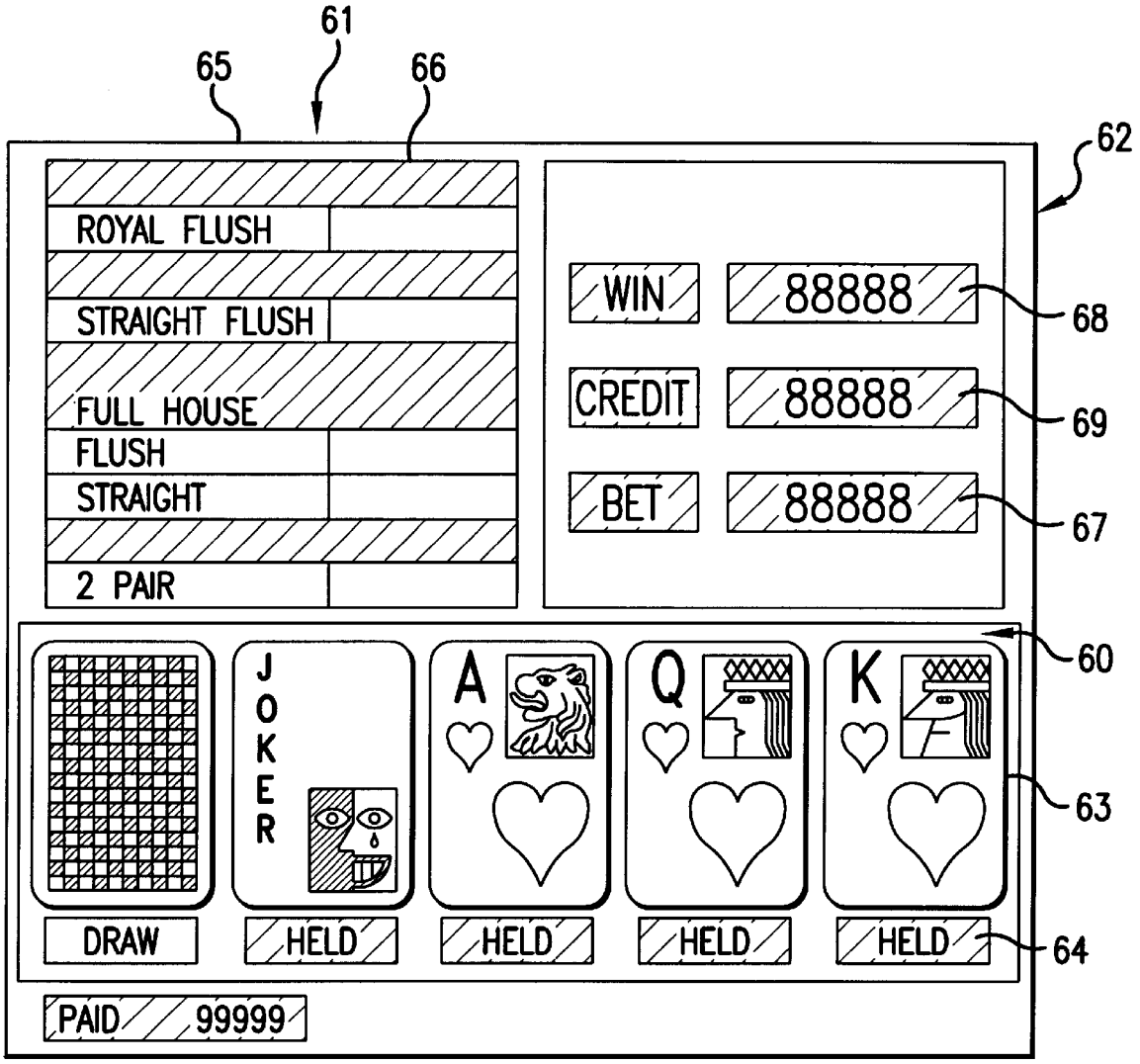
FIG. 6 is a view showing, by way of example, a game displayed on a display screen of the image display game apparatus shown in FIG. 1.

FIG. 6 shows, by way of example, an image displayed on the display screen 27*a* when the player starts to play a poker game on the image display card game apparatus. The display screen 27*a* is divided into a card display area 60, an odds table display area 61, and a medal number display area 62.

The card display area 60 displays a horizontal array of randomly selected five cards 63 and a hold indicator 64 for indicating a choice of the player as to which card or cards 63 are to be replaced. The hold indicator 64 displays "HELD" below a card 63 when the player chooses not to replace the card 63, i.e., when the player presses the corresponding HOLD button 36, and displays "HOLD" below a card 63 when the player chooses to replace the card 63 or has not decided whether to replace the card 63 or not. When the player presses the DEAL/DRAW button 31, a card 63 which the player has chosen to replace is displayed with its face down, as with the leftmost card 63 in FIG. 8, and the hold indicator 64 displays "DRAW" below the card 63. Thereafter, a card 63 with a new rank marking is displayed with its face up in place of the card 63 above "DRAW" in the hold indicator 64.

The odds table display area 61 displays a prize-winning hand indicator 65 for displaying a plurality of predetermined prize-winning hands and an odds indicator 66 for displaying odds assigned respectively to the prize-winning hands displayed in the prize-winning hand indicator 65. In the example shown in FIG. 6, no odds are displayed in the odds indicator 66. Usually, however, odds expressed by numbers are displayed in the odds indicator 66.

The medal number display area 62 displays a bet indicator 67 for displaying the number of medals which the player has bet, a won number indicator 68 for displaying the number of medals which is represented by the number of bet medals multiplied by the odds when the cards 63 presently displayed in the card display area 60 make up a prize-winning hand, and a credit indicator 69 for displaying the present total number of medals which have been inserted and won by the player, i.e., the number of medals (credit) presently possessed by the player.

Operation of the image display card game apparatus will be described with reference to FIGS. 1 through 8.

Figure 7:
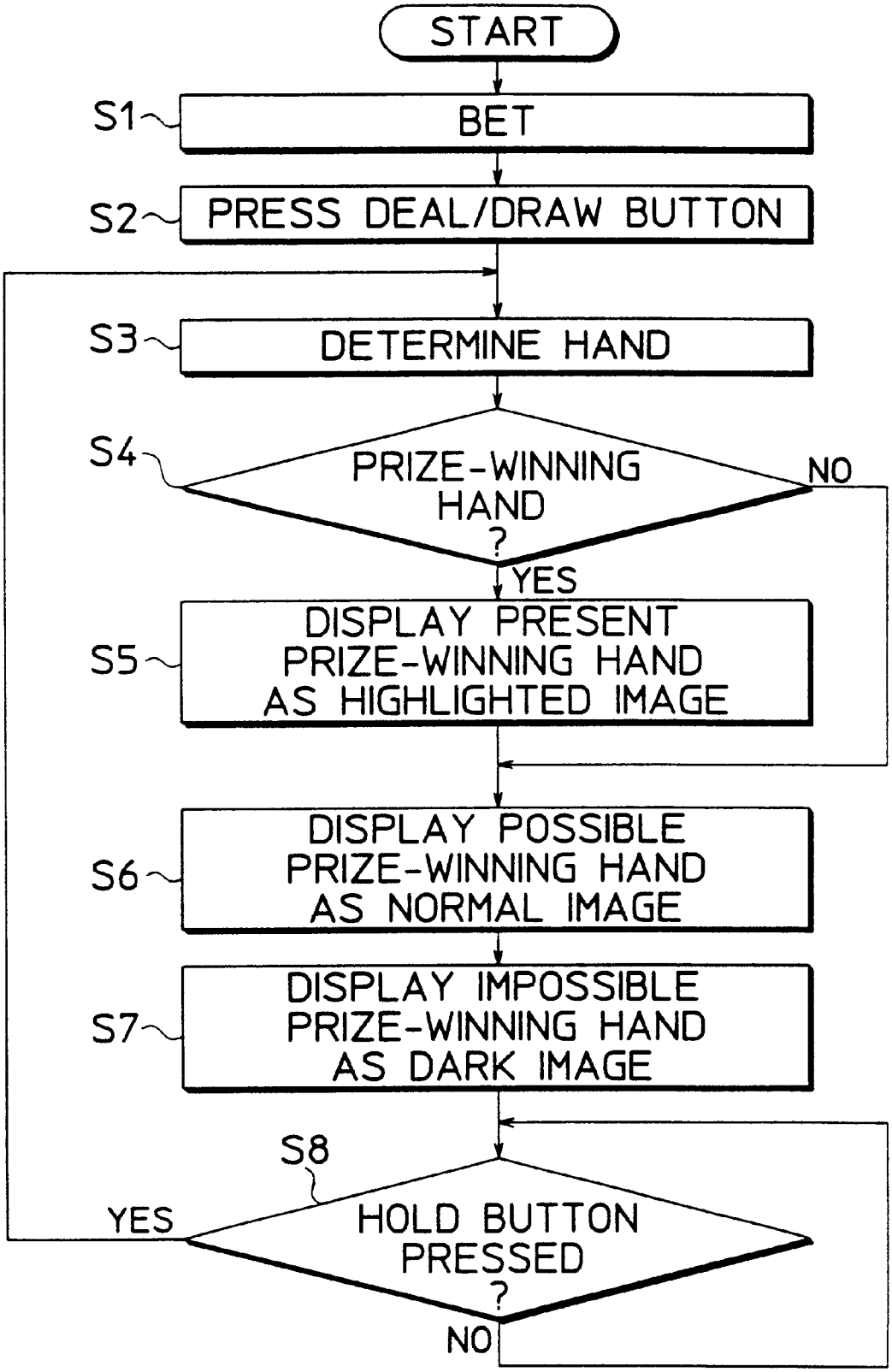
FIG. 7 is a flowchart of an operation sequence of the image display game apparatus shown in FIG. 1.

FIG. 7 shows flowchart of a operation sequence of the poker game program stored in the ROM 51 of the image display card game apparatus according to the present invention.

Figure 8A:
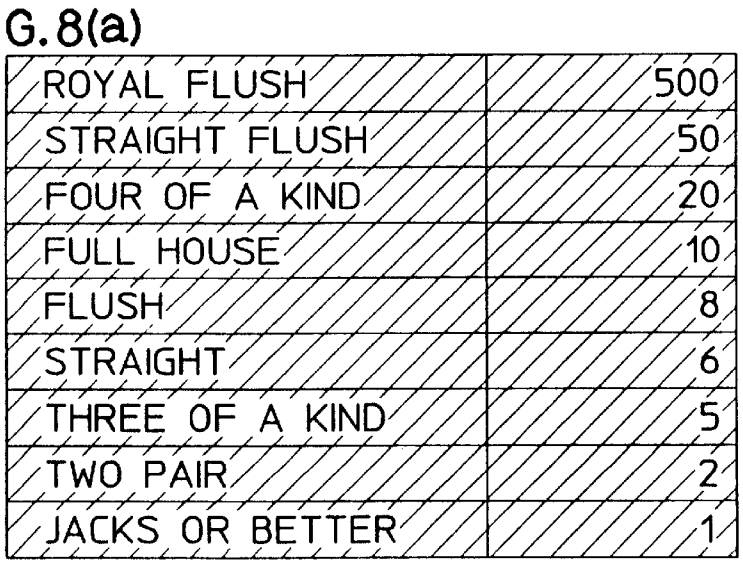
FIGS. 8(*a*) through 8(*c*) are diagrams showing, by way of example, images displayed in an odds table indicator of a display screen and an array of cards displayed in a card display area thereof.
Figure 8B:
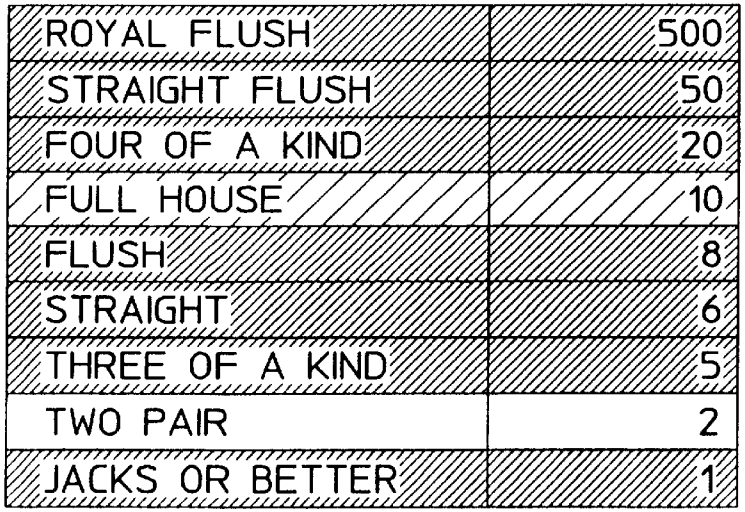
Figure 8C:
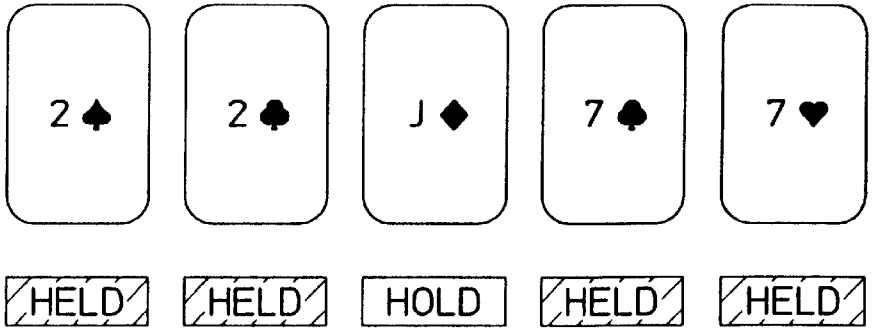

When the player inserts medals into the medal insertion slot 29, the poker game program stored in the ROM 51 starts to be run by the CPU 50. In a step Sl, the CPU 50 waits for the player to decade how many medals of the inserted medals are to be bet on the poker game by pressing the MAW BET button and the ONE BET button 3. After the CPU 50 detects when the MAX BET button 32 and the ONE BET button 33 are pressed, the CPU 50 changes the number of medals displayed in the bet indicator 67. At this time, as shown in FIG. 8(*a*), the prize-winning hand indicator 65 and the odds indicator 66 are displayed in their entirety in one color shade. Images of prize-winning hands and their odds are actually displayed as images of different color shades in the prize-winning hand indicator 65 and the odds indicator 66 on the display screen 27*a*, but illustrated as differently shaded black-and-white images in FIGS. 8(*a*) through 8(*c*).

In a step S2, the CPU 50 waits for the player to press the DEAL/DRAW button 31. After the CPU 50 detects when the DEAL/DRAW button 31 is pressed, the CPU 50 controls the display controller 57 to display a horizontal array of randomly selected five cards 63, with their faces up, on the display screen 27*a*.

From the displayed cards 63, the player selects unwanted cards 63 to be replaced and desired cards 63 not to be replaced in an attempt to achieve a prize-winning hand, and presses those HOLD buttons 36 which correspond to the desired cards 63 not to be replaced, thereby indicating that those desired cards 63 do not need to be replaced. In a step S3, the odds display device 50*c* determines a prize-winning hand made up of those cards 63 which do not need to be replaced, i.e., those cards 63 with the associated HOLD buttons 36 pressed, and a prize-winning hand which may possibly be achieved by the replacement of the unwanted cards 63 as indicated by the player.

In a step S4, the odds display device 50*c* determines whether a prize-winning hand has already been achieved or not. If a prize-winning hand has already been achieved, control proceeds to a step S5. If not, then control jumps to a step S6.

In the step S5, the odds display device 50*c* controls the display controller 57 to display already achieved prize-winning hands as a highlighted (unshaded) image in the prize-winning hand indicator 65 and corresponding odds as a highlighted (unshaded) image in the odds indicator 66. In the step S6, the odds display device 50*c* controls the display controller 57 to display a possible prize-winning hand as a normal (partly shaded) image in the prize-winning hand indicator 65 and corresponding odds as a normal (partly shaded) image in the odds indicator 66. In a next step S7, the odds display device 50*c* controls the display controller 57 to display impossible prize-winning hands as a dark (fully shaded) image in the prize-winning hand indicator 65 and corresponding odds as a dare (fully shaded) image in the odds indicator 66.

For example, randomly selected five cards 63 are displayed with their faces up on the display screen 27*a*, as shown in FIG. 8(*c*), and the player presses the HOLD buttons 36 corresponding to four cards 63, two on the right and two on the left, "2S", "2C", "7C", "7H", indicating that these cards 63 are to be held, i.e., not to be replaced. In this case, the odds table display area 61 displays prize-winning hands and their odds as shown in FIG. 8(*b*). Specifically, since the four cards 63 with rank markings "2S", "2C", "7C", "7H" make up a prize-winning hand called two pairs, the corresponding prize-winning hand "TWO PAIR" and its odds are displayed as highlighted images respectively in the prize-winning hand indicator 65 and the odds indicator 66. In as much as a central card 63 with a rank marking "JD" may possibly be replaced with a new card 63 with a rank marking "2H", "2D", "7D", or "7S", resulting in a combination making up a prize-winning hand called full house, the corresponding prize-winning hand "FULL HOUSE" and its odds are displayed as normal images respectively in the prize-winning hand indicator 65 and the odds indicator 66. No other prize-winning hands are presently achieved and will possibly be achieved. Therefore, the other prize-winning hands and their odds are displayed as dark images respectivley in the prize-winning hand indicator 65 and the odds indicator 66. As described above, the highlighted, normal, and dark images are in fact displayed as images of different color shades on the display screen 27*a*. Specifically, the highlighted images are displayed as images of a brighter color shade, and th dark images are displayed as images of darker color shade. However, the highlighted, normal, and dark images may be displayed as other images provided they can visually, be distinguished from each other.

As described above, a presently achieved prize-winning hand represented by presently displayed cards and its odds, and also a prize-winning hand which may possibly be achieved by replacing a card or cards and its odds are displayed in display modes different from a display mode for other prize-winning hands and their odds. Therefore, the presently achieved prize-winning hand and its odds, and the possible prize-winning hand and its odds are displayed in a manner to be visually distinguished from the other prize-winning hands and their odds. The player can easily identify the presently achieved prize-winning hand and its odds, and the possible prize-winning hand and its odds, and is prevented from replacing a card or cards due to a wrong decision. The prize-winning hands and their odds which are thus displayed in different display modes provide appropriate guidance for players who are not well accustomed to the card game played on the display image card game apparatus. Because the display image card game apparatus assists the player in making correct decisions and helps unskilled players become quickly accustomed to the card game, the player finds the card game interesting and unskilled players can enjoy the card game.

After the step S7, the CPU 50 waits for the player to press any one of the HOLD buttons 36 in a step S8. If the CPU 50 detects ashen the player presses either one of the HOLD buttons 36, then control goes back to the step S3. The CPU 50 then repeats the steps S3~S8.

Thereafter, the player presses the DEAL/DRAW button 31 to replace a card or cards 63 which are indicated by a HOLD button or buttons 36 that have not been pressed. Specifically, the card replacement device 50*a* displays the card or cards 63 With their faces down, as with the leftmost card 63 in FIG. 6, and displays a card or cards 63 marked with a new rank marking or markings, with their faces up, in place of the card or cards 63 displayed with their faces down.

The prize-winning hand determining device 50*b* determines whether the new combination of cards presently displayed on the display screen 27*a* makes up a predetermined prize-winning hand or not. If the new combination makes a predetermined prize-winning hand, then the prize-winning hand determining device 50*b* multiplies the odds assigned to the prize-winning hand by the number of medals bet, thereby calculating the number of medals won by the player. If the new combination does not make up a predetermined prize-winning hand, then the player cannot acquire any medals.

The poker game continues until the number of medals possessed by the player becomes nil or the player presses the COLLECT/PAYOUT button 34 to indicate the discharge charge of medals won by the player. Specifically, when the player presses the COLLECT/PAYOUT button 34, the CPU 50 confirms the number of medals (credit) presently acquired by the player, and outputs a signal to instruct the medal hopper 42 to discharge as many medals as the confirmed number of medals. In response to such a signal, the medal hopper discharges the medals through the medal discharge outlet 38.

Although a certain preferred embodiment of the present invention has been shown and described in detail, it should be understood that various changes and modifications may be made therein without departing from the scope the appended claims.

What is claimed is:

1. An image display game apparatus comprising:

an image display unit having a display screen;

display control means for controlling said image display unit to display a plurality of rank markings on said display screen;

replacement indicating means operable by a player for indicating replacement of at least one of the rank markings;

rank marking replacing means for replacing said at least one of the rank markings in response to a replacement indicating signal from the replacement indicating means;

odds display means for displaying informational displays including fixed odds of possible winnable combinations and delineating sub-displays which delineate which of said informational displays are applicable to the rank markings presently displayed on the display screen and not indicated for replacement by the replacement indicating means;

end indicating means operable by the player for indicating an end of a game session; and prize-winning hand determining means for determining whether the rank markings displayed on said display screen achieve a prize-winning hand in response to an end indicating signal from said end indicating means.

2. An image display game apparatus comprising:

an image display unit having a display screen;

display control means for controlling said image display unit to display a plurality of rank markings on said display screen;

replacement indicating means operable by a player for indicating replacement of at least one of the rank markings;

rank marking replacing means for replacing said at least one of the rank markings in response to a replacement indicating signal from said replacement indicating means;

odds display means for displaying informational displays including fixed odds of possible winnable combinations and delineating sub-displays which delineate which of said informational displays are applicable to any potential prize-winnable combination which is achievable by the rank markings presently displayed on the display screen and not indicated for replacement by the replacement indicating means in conjunction with rank markings which are yet undisplayed and which subsequently replace those rank markings indicated for replacement by said replacement indicating means, end indicating means operable by the player for indicating an end of a game session; and prize-winning hand determining means for determining whether the rank markings displayed on said display screen achieve a prize-winning hand in response to an end indicating signal from said end indicating means.

3. An image display game apparatus according to claim 1, wherein said delineating sub-displays delineate the applicability of the information displays using color shades different from each other.

4. An image display game apparatus according to claim 2, wherein said delineating sub-displays delineate the applicability of the information displays using color shades different from each other.

5. A method of playing a game which includes rank markings comprising:

displaying an initial plurality of rank markings;

tentatively selecting by a game player which of said displayed initial plurality of rank markings are to be retained and which are to be replaced;

for each tentative selection made by the game player:

(a) displaying any winnable prize-winning combinations of the rank markings selected by the game player to be retained; and (b) displaying any possible prize-winnable combinations obtainable by the rank markings selected by the game player to be retained in conjunction with the subsequent rank markings which replace the rank markings selected by the game player to be replaced;

making a game-ending selection by the game player of which of said displayed plurality of rank markings are to be retained and which are to be replaced; and displaying any prize-winning combinations which have been obtained by said game-ending selection by said game player;

whereby a game player is enabled to make a plurality of said tentative selections in order to view the displays of steps (a) and (b) for each tentative selection prior to making said game-ending selection.

6. A method of playing a game according to claim 5 wherein said step (a) includes:

(a-1) displaying a plurality of informational displays; and (a-2) displaying delineating sub-displays for each informational display to delineate the applicability of each associated informational display.

7. A method of playing a game according to claim 6 further comprising retaining said informational displays (a-1) while changing said delineating sub-displays (a-2) for various tentative selections made by a game player.

8. A method of playing a game according to claim 7 wherein said step of changing the delineating sub-displays includes:

(a-3) displaying the delineating sub-display in a first state to delineate applicability of the associated informational display; and (a-4) displaying the delineating sub-display in a second state to delineate non-applicability of the associated informational display.

9. A method according to claim 8 wherein said step (a-3) includes displaying said first state in one color and said step (a-4) include displaying said second state in another color.

10. A method according to claim 8 wherein said step (a-3) includes displaying said first state in one shade and said step (a-4) include displaying said second state in another shade.

11. A method of playing a game according to claim 6 further comprising displaying said delineating sub-displays as a background display to said informational displays.

12. A method of playing a game according to claim 5 further comprising displaying a comprehensive list of possible winnable combinations, and performing the last said step of displaying said comprehensive list of possible winnable combinations simultaneously with said steps (a) and (b).

13. A method of playing a game according to claim 5 further comprising displaying all possible prize-winnable combinations and the fixed odds thereof, and performing the last said step of displaying all possible prize-winnable combinations and the odds thereof simultaneously with steps (a) and (b).

14. A method of playing a game according to claim 5 wherein said step (b) includes:

(b-1) displaying a plurality of informational displays; and (b-2) displaying delineating sub-displays for each informational display to delineate the applicability of each associated informational display.

15. A method of playing a game according to claim 14 further comprising retaining said informational displays (b-1) while changing said delineating subdisplays (b-2) for various tentative selections made by a game player.

16. A method of playing a game according to claim 15 wherein said step of changing the delineating sub-displays includes:

(b-3) displaying the delineating sub-display in a first state to delineate applicability of the associated informational display; and (b-4) displaying the delineating sub-display in a second state to delineate non-applicability of the associated informational display.

17. A method according to claim 16 wherein said step (b-3) includes displaying said first state in one color and said step (b-4) include displaying said second state in another color.

18. A method according to claim 16 wherein said step (b-3) includes displaying said first state in one shade and said step (b-4) include displaying said second state in another shade.

19. A method of playing a game according to claim 14 further comprising displaying said delineating sub-displays as a background display to said informational displays.

20. A method of playing a game which includes rank markings comprising:

displaying informational displays which include possible winnable combinations of said rank markings and odds therefore;

displaying an initial plurality of rank markings;

tentatively selecting by a game player which of said displayed initial plurality of rank markings are to be retained and which are to be replaced;

displaying for each tentative selection:

first delineating sub-displays which delineate which of said informational displays are applicable to the retained rank markings;

second delineating sub-displays which delineate which of said informational displays are applicable to the retained rank markings in conjunction with potential rank markings which subsequently replace those rank markings tentatively selected by the game player to be replaced; and third delineating sub-displays which delineate which of said informational displays are non-winnable and therefore not delineated by said first and second delineating sub-displays;

making a game-ending selection by the game player as to which of said displayed initial plurality of rank markings are to be retained and which are to be replaced; and displaying an indication of any prize-winning combinations which have been obtained by said game-ending selection by said game player;

whereby a game player is enabled to make a plurality of said tentative selections prior to making said game-ending selection in order to view said first, second and third delineating sub-displays prior to making said game-ending selection.

* * * * *